United States Patent [19]

Bui-Hai et al.

[11] 4,106,026

[45] Aug. 8, 1978

[54] CORRUGATED HORN WITH A LOW STANDING WAVE RATIO

[75] Inventors: Nhu Bui-Hai; Alain Bourgeois, both of Paris, France

[73] Assignee: Thomson-CSF, Paris, France

[21] Appl. No.: 737,795

[22] Filed: Nov. 1, 1976

[30] Foreign Application Priority Data

Nov. 4, 1975 [FR] France ..... 75 33698

[51] Int. Cl.[2] ..... H01Q 13/02

[52] U.S. Cl. ..... 343/786

[58] Field of Search ..... 343/786, 854, 909

[56] References Cited

U.S. PATENT DOCUMENTS

| | | | |
|---|---|---|---|
| 2,985,879 | 5/1961 | Du Hamel | 343/792.5 |
| 3,754,273 | 8/1973 | Takeich et al. | 343/786 |
| 3,949,406 | 4/1976 | Yuard | 343/786 |
| 4,012,743 | 3/1977 | Maciejewski | 343/786 |

*Primary Examiner*—Eli Lieberman

*Attorney, Agent, or Firm*—Cushman, Darby & Cushman

[57] ABSTRACT

A corrugated horn of the exponential type is provided with corrugations whose depth decreases exponentially from the throat of the horn towards its mouth. Such corrugations have the effect of reducing the stationary wave ratio.

2 Claims, 4 Drawing Figures

CORRUGATED HORN WITH A LOW STANDING WAVE RATIO

This invention relates to corrugated horns with symmetry of revolution, of the type used in the hyperfrequency field as antennae or as primary sources of antennae.

The radiation diagrams of such horns have a symmetry of revolution.

Known horns of this type are conical horns. The depth of the corrugations is constant, generally equal to about λ/4 (λ, operational wavelength of the horn), the width of the corrugation is about λ/10 and the length of the smooth part (i.e. the part without corrugations) is, in order to facilitate the matching of the horn, about one λ.

The corrugations improve the symmetry of the radiation diagram and reduce the secondary lobes. However those known horns have a comparatively high stationary wave ratio.

The object of the present invention is to overcome this drawback while preserving the symmetry of revolution of the radiation diagram and a low level of the secondary lobes.

This object is achieved in particular by the use of horns of the exponential type, i.e. horns the cross-sectional area of which increases exponentially with axial distance.

According to the invention, their is provided a corrugated horn of the exponential type, wherein the depth of the corrugations decreases exponentially from the throat of the horn towards its mouth.

The invention will be better understood and other features thereof will become apparent from the following description in conjunction with the accompanying drawings, wherein:

FIG. 1 is a longitudinal section through a corrugated horn, 1, of the exponential type, which has symmetry of revolution and, hence, a circular cross-section. From its throat 10 towards its mouth 11, this horn comprises:

Figure 1:
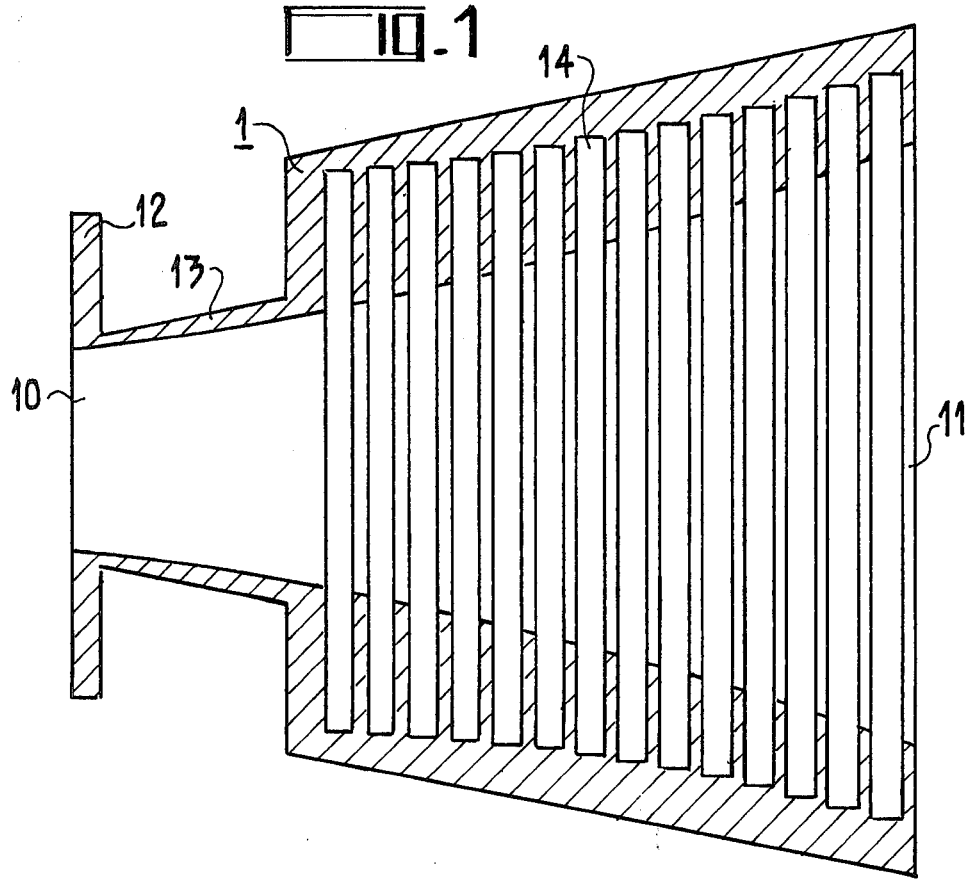
FIG. 1 is a section through a horn according to the invention.

a connection flange 12, a smooth part 13, a part 14, with 14 transverse corrugations.

This horn, which has been designed to operate in the band from 6.43 to 7.11 GHz, has a length of 140 mm, an aperture diameter of 100 mm and a diameter of 34 mm at the narrowest point of its throat.

The smooth part 13 of this horn has a length of approximately 40 mm which substantially corresponds to the mean operational wavegength λ of the horn.

The corrugations of the part 14 all have a width of 5 mm and the thickness of the wall between two consecutive corrugations is 2 mm. The depth of these corrugations decreases exponentially from the throat of the horn towards its mouth. The corrugation closest to the throat of the horn has a depth of 23 mm, i.e. approximately λ/2, whilst the corrugation closest to the mouth of the horn has a depth of 11.5 mm, i.e. approximately λ/4.

By comparison with conical corrugated horns, the stationary wave ratio is greatly reduced without the symmetry of revolution of the principal lobe being affected, whilst the level of the secondary lobes is kept below −40 dB relative to the maximum level of the principal lobe.

Figure 2:
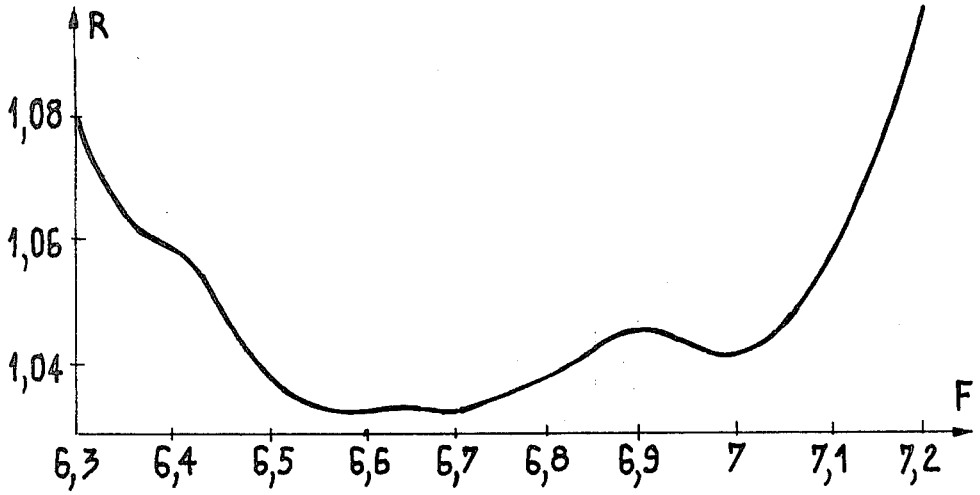
FIG. 2 is a diagram relating to the horn shown in FIG. 1.

FIG. 2 shows how the stationary weve ratio R of the horn shown in FIG. 1 varies in dependence upon the operational frequency F expressed in gigahertz. Thus, for a band of 10% centred on 6.75 GHz, the stationary wave ratio is below 1.06.

By way of indication, the aperture angle of the antenna shown in FIG. 1 is:

at −3dB, 36° in the planes E and H, at −10dB, 63° in the planes E and H, and at −20dB, 88° in the plane E and 91° in the plane H.

Figure 3:
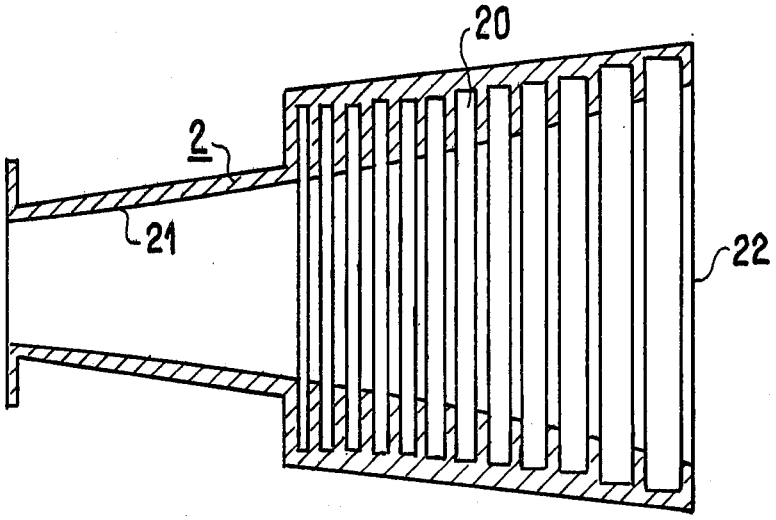
FIGS. 3 and 4 are sections through other horns according to the invention.
Figure 4:
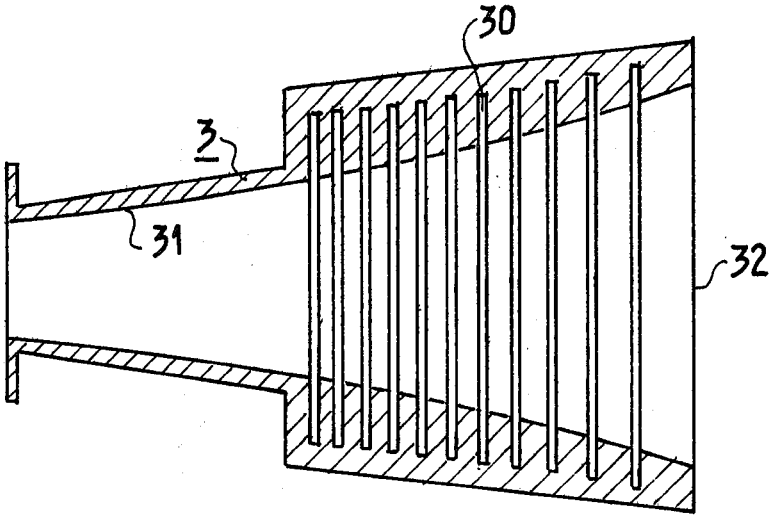

FIGS. 3 and 4 are longitudinal sections through two other corrugated horns of the exponential type, with symmetry of revolution; these horns have an overall length of 200 mm and are intended to operate in the band from 6.43 to 7.11 GHz.

The horn 2 shown in FIG. 3 comprises a smooth part 21 and a part 20 with twelve transverse corrugations. As in the case of the horn shown in FIG. 1, the depth of these corrugations decreases exponentially from λ/2 to λ/4 (where λ is a length corresponding to the mean operational frequency of the horn) from the smooth part 21 towards the mouth 22 of the horn, and the thickness of the walls between consecutive corrugations is constant, i.e. is the same irrespective of the corrugations in question. On the other hand, in the horn 2, in contrast to the horn shown in FIG. 1, the width of the corrugations is not the same from one corrugation to the following corrugation. It increases exponentially from the smooth section 21 towards the mouth 22. This exponential variation of the width of the corrugations, in conjunction with the exponential variation of their depth, contributes towards providing this horn with a very low stationary wave ratio.

The horn 3 shown in FIG. 4 comprises a smooth part 31 and a part 30 with eleven transverse corrugations. As in the case of the horn shown in FIG. 1, the depth of these corrugations decreases exponentially from λ/2 to λ/4 from the smooth part 31 towards the mouth 32 of the horn, and all the corrugations have the same width. On the other hand, in the horn 3, in contrast to the horn shown in FIG. 1, the thickness of the walls separating two consecutive corrugations is not constant: it increases exponentially from the smooth part 31 towards the mouth 32. This exponential variation of the thickness of the walls between the corrugations, in conjunction with the exponential variation of the depth of these corrugations, also contributes towards providing the horn with a low stationary wave ratio.

Naturally the invention is by no means limited to the examples described above. Thus, the width of the corrugations may also decrease exponentially from the smooth section of the horn towards its mouth, as may the thickness of the walls between the corrugations. In addition, the variations in the thickness of corrugations and in the width of the walls between the corrugations may be combined in one and the same horn.

Of course, the invention is not limited to the embodiments described and shown which were given solely by way of example.

What is claimed is:

1. A corrugated horn of the exponential type, wherein the depth of the corrugations decreases exponentially from the throat of the horn towards its mouth, the extreme depth values of said corrugations are respectively λ/2 and λ/4, λ being a wavelength corresponding to a mean frequency of the operational frequency band, and the width of the corrugations varies exponentially from the throat of the horn towards its mouth.

2. A corrugated horn of the exponential type, wherein the depth of the corrugations decreases exponentially from the throat of the horn towards its mouth, the extreme depth values of said corrugations are respectively λ/2 and λ/4, λ being a wavelength corresponding to a mean frequency of the operational frequency band, and the distance between two consecutive corrugations varies exponentially from the throat of the horn towards its mouth.

* * * * *